US008455166B2

(12) United States Patent
Op De Beeck et al.

(10) Patent No.: US 8,455,166 B2
(45) Date of Patent: Jun. 4, 2013

(54) UV CURABLE TONER WITH IMPROVED SCRATCH RESISTANCE

(75) Inventors: Werner Op De Beeck, Putte (BE); Michel Vervoort, Gierle (BE); Lode Deprez, Wachtebeke (BE)

(73) Assignee: Xeikon Manufacturing N.V., Lier (BE)

( * ) Notice: Subject to any disclaimer, the term of this patent is extended or adjusted under 35 U.S.C. 154(b) by 812 days.

(21) Appl. No.: 12/219,555

(22) Filed: Jul. 24, 2008

(65) Prior Publication Data

US 2009/0029278 A1 Jan. 29, 2009

(30) Foreign Application Priority Data

Jul. 24, 2007 (EP) ..... 07014478

(51) Int. Cl.
*G03G 9/00* (2006.01)

(52) U.S. Cl.
USPC ..... 430/108.8; 430/108.1; 430/124.1

(58) Field of Classification Search
USPC ..... 430/108.1, 108.4, 108.8, 109.1, 109.4, 430/124.1, 124.23, 124.3
See application file for complete search history.

(56) References Cited

U.S. PATENT DOCUMENTS

| | | | | |
|---|---|---|---|---|
| 5,837,406 | A | 11/1998 | Tavernier et al. | |
| 5,858,596 | A * | 1/1999 | Tajima et al. | 430/108.2 |
| 5,928,825 | A | 7/1999 | Eguchi et al. | |
| 6,733,940 | B2 | 5/2004 | Terao et al. | |
| 2002/0058193 | A1 * | 5/2002 | Tosaka et al. | 430/108.23 |
| 2004/0142265 | A1 | 7/2004 | Tomita et al. | |
| 2005/0100808 | A1 | 5/2005 | Hashimoto et al. | |
| 2005/0137278 | A1 | 6/2005 | Fromm et al. | |
| 2006/0154162 | A1 * | 7/2006 | Zhou et al. | 430/108.1 |
| 2006/0228639 | A1 | 10/2006 | Young et al. | |
| 2007/0031751 | A1 | 2/2007 | Teishev et al. | |
| 2007/0122728 | A1 * | 5/2007 | Vanbesien et al. | 430/108.4 |

FOREIGN PATENT DOCUMENTS

| | | | |
|---|---|---|---|
| EP | 0 667 381 | A2 | 8/1995 |
| EP | 1 111 474 | A2 | 6/2001 |
| EP | 1 437 628 | A1 | 7/2004 |
| EP | 1 793 281 | A1 | 6/2007 |
| EP | 1 930 780 | A1 | 6/2008 |
| WO | WO 2005/116778 | A1 | 12/2005 |

OTHER PUBLICATIONS

Communication of EPO regarding EP 07 014 478.7, Jun. 4, 2010.
Lode Deprez. Werner Op De Beeck, "Digital Production Printing With UV-Curable Dry Toners for Paper and Flexible Packaging", IS&T's NIP19: International Conference on Digital Printing Technologies, Final Program and Proceedings, New Orleans. LA. U S., Sep. 28-Oct. 3, 2003, pp. 486-491.
Akihiro Eida and Jun Shimizu, "Study on the Effects of Wax in the Polyester Color Toner", IS&T NIP16, 2000 International Conference on Digital Printing Technologies, pp. 618-622.

* cited by examiner

*Primary Examiner* — Stewart Fraser
(74) *Attorney, Agent, or Firm* — Bacon & Thomas, PLLC

(57) ABSTRACT

A radiation curable toner is described having at least a radiation curable binder (e.g. a UV curable polymer), a photoinitiator, and a wax; wherein the wax is present in a concentration ranging from 0.3 to 3% by weight. The ratio of scratch resistance before curing is preferably at least 2. The toner may be used in a developer, e.g. a two-component developer, for printing or copying.

31 Claims, 2 Drawing Sheets

UV CURABLE TONER WITH IMPROVED SCRATCH RESISTANCE

FIELD OF THE INVENTION

The present invention relates to imaging methods, apparatus and consumables and in particular to improved radiation curable toner compositions, e.g. UV-curable toners, as well as to improved dry developer compositions, to methods of imaging and marking, e.g. printing or copying, using such toners and/or developers, and to media marked with such toners or developers. The present invention also relates to a more efficient method of fusing and curing dry toner particles, and to marking devices such as printers or copiers including such toner or developing compositions.

BACKGROUND OF THE INVENTION

In imaging methods as e.g. electro(photo)graphy, magnetography, ionography, etc. a latent image is formed that is developed by attraction of so called toner particles. Afterwards the developed latent image (toner image) is transferred to a final substrate and fused to this substrate. Toner particles are basically polymeric particles comprising a polymeric resin as main component and various ingredients mixed with said toner resin. Apart from colourless toners, which are used e.g. for finishing function or security purposes (e.g. when a clear fluorescent dye, pigment or phosphor is used), the toner particles comprise at least one black and/or colouring substances, e.g., coloured pigment, e.g. magenta, cyan or yellow.

In the beginning colour electro(photo)graphy was mostly used for producing coloured images (e.g. graphic arts, presentations, coloured books, dissertations, . . . ). When the process speed of producing digital coloured images increased, other more productive applications also came into the picture (direct mailing, transactional printing, packaging, labelprinting, security printing, . . . ). This means that after an electro(photo)graphy marking operation, the toner images further have to withstand some external factors applied during the subsequent treatments. The problems associated with multiple, superimposed layers of toner particles that are in one way or another fixed on a substrate are manifold, are not only with respect to image quality but also with respect to image stability and with respect to mechanical issues.

In 2003, in Deprez, Lode; Op de Beeck, Werner; Rosenberger, Karolina. "Digital production printing with UV-curable dry toners for paper and flexible packaging" IS&T's NIP19: International Conference on Digital Printing Technologies, Final Program and Proceedings, New Orleans, La., United States, Sep. 28-Oct. 3, 2003 (2003), 486-491) it has already been shown that the mechanical resistance of UV cured curable toner can be improved based on a Taber Abraser test.

In patent application US2007/0031751A1 a liquid developer is described which comprises an UV curable component to improve the adhesion to the substrate because liquid toner shows a limited adhesion onto paper. By including the UV curable component also the scratch resistance was improved.

In US 2005/0137278 a chemically produced toner is described which contains typically 5-10% of wax (in order to prevent hot offset) and a certain amount of UV crosslinking agent to improve the rub resistance measured with toluene. The wax compound in this application is encapsulated into the center of the toner particle.

The use of an additional layer on top of the colour image to improve the scratch resistance is described in U.S. Pat. No. 5,837,406 where a special reactive silicon oil is described.

The use of waxes to improve the scratch resistance is also known in the field. Examples are U.S. Pat. No. 6,733,940 where a MICR toner is described with a typical wax concentration of 1.5 to 5% and U.S. Pat. No. 5,928,825 where a grafted wax is described in a concentration of 2-15%.

In electrophotographic processes based on hot roller, fusing waxes are very often used to prevent hot offset. Documents like EP 1111474, US2006/0228639, US2005/0100808 and US2004/0142265 and IS&T NIP16 "Study on the effects of wax in polyester color toner" of Eida of KAO Corporation describe the use of waxes. From those documents can be learned that in order to be useful in hot roller fusing systems the amount of wax which is generally used is between 2-15%. In chemical produced toners the wax content is generally somewhat higher. When this amount of wax is present, the need for silicone oil in hot roller fusing can be prevented. From all those references only a general description for toners with an improved scratch resistance is found and also general teachings for the use of waxes in toner but a toner with a very high scratch resistance combined with very stable charging properties is still not attainable with the above teachings.

SUMMARY OF THE INVENTION

It is an object of the invention to provide a good toner, a good developer, good methods of printing and media printed with the toner. An advantage of the present invention can be a high scratch resistance. Embodiments of the present invention also has the advantage of providing a toner with a high scratch resistance in a non contact fusing process. Embodiments of the present invention have the further advantage to provide a toner with a high scratch resistance over time. Embodiments of the present invention have a further advantage of providing a toner with good electrophotographical properties like chargeability and lifetime performance. It is a further advantage of the invention to provide a toner to produce images that are very resistant to high temperatures and organic solvents. It is a further advantage of the invention to provide a rounded toner with a high scratch resistance.

According to a first aspect, the present invention provides a radiation curable toner comprising at least a radiation curable binder (e.g. a UV curable polymer), a photoinitiator, a pigment or colouring agent, and a wax; wherein the wax is present in a concentration ranging from 0.3 to 3% by weight of the toner.

The ratio of scratch resistance after curing to scratch resistance before curing is preferably at least 2.

The wax can be of any type suitable for the marking process intended but preferably the melting point of the wax is below 140° C. and more preferably below 120° C.

According to a certain embodiment the wax is preferably present in an amount less than 3% in weight and even more preferably less than 2% by weight of the toner.

In a preferred embodiment the wax contains polar moieties like a hydroxyl or carboxylic group.

Preferably the radiation curable resin comprises a (meth) acrylated polyester resin and more preferably a (meth)acrylated epoxy/polyester resin and even more preferably a blend of a) a (meth)acrylated epoxy/polyester and b) a (meth)acrylated polyurethane resin. Preferably, the milli-equivalent amount of double bounds per gram of said radiation curable resin is >0.7 meq/gr.

According to a preferred embodiment, the dry toner particles have a volume average diameter between 3 and 20 μm.

The particles according to a certain embodiment of the invention preferably have a viscosity of the toner particles between 50 and 5,000 Pa·s at 120° C.

The invention also covers dry electrostatographic developer composition comprising carrier particles and toner particles as defined herein above. This composition may be such that said carrier particles have a volume average particle size of between 30 to 65 μm, and said carrier particles comprise a core particle coated with a resin in an amount of 0.4 to 2.5% by weight, and the absolute charge expressed as fC/10 μm (q/d) is between 3 and 13 fC/10 μm.

The invention also covers a method of fusing and curing dry toner particles according to the invention, wherein the toner particles are image wise deposited on a substrate, said toner particles are then fused onto said substrate, and finally the fused toner particles are cured by means of radiation. Preferably the fusing is done by a non-contact fusing method or a gentle simplex oilless fusing system. Preferably, the radiation used for curing is UV light, and said toner particles comprise one or more photoinitiators for this light. In a preferred embodiment the fusing and curing is done in-line.

The invention also covers an apparatus for forming a toner image on a substrate comprising: i) means for supplying dry toner particles, ii) means for image-wise depositing said dry toner particles on said substrate, iii) means for fusing said toner particles on said substrate, and iv) means for off-line or in-line radiation curing said fused toner particles according to the invention and wherein the substrate is fed by a web, wherein the means for supplying dry toner particles contains a radiation curable toner comprising at least a radiation curable binder (e.g. a UV curable polymer), a photoinitiator, a pigment or colouring agent, and a wax; wherein the wax is present in a concentration ranging from 0.3 to 3% by weight.

The present invention also includes a medium such as paper, aluminum foil, board or polymeric sheet or other products marked with fused toner of the present invention.

Further objects and advantages of the present invention will become evident from the detailed description hereinafter.

DETAILED DESCRIPTION OF THE INVENTION

Figure 1:
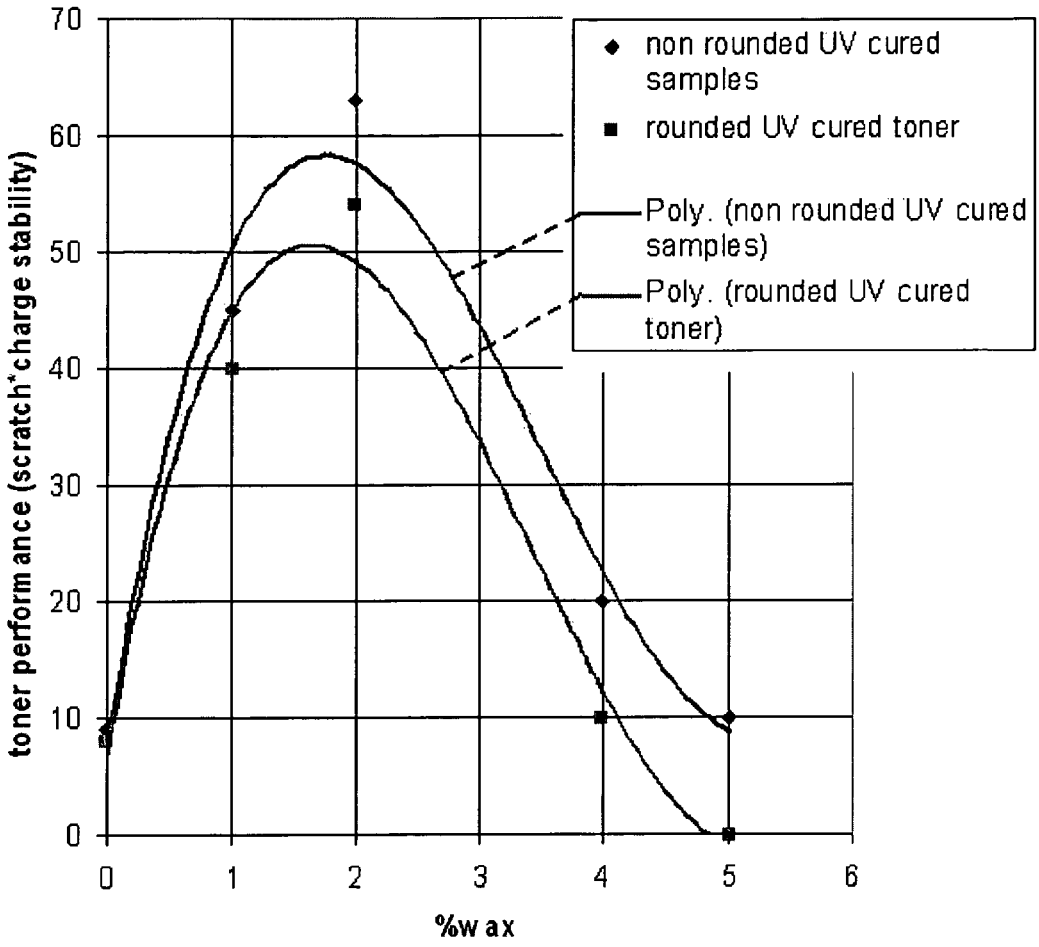
FIG. 1 is a graphical representation of the toner performance (as evaluated on scratch resistance and charge stability) as a function of the weight % amount of wax in the toner.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

The present invention relates to imaging methods and in particular to improved radiation curable toner compositions, preferably UV-curable toner particles, as well as to improved dry developer compositions. The present invention also relates to a more efficient method of fusing and curing dry toner particles, and to substrates marked, e.g. printed with a toner comprising said improved radiation curable toner compositions. The present invention also relates to marking devices such as printers including such toner or developing compositions. The embodiments are provided as examples of the invention but are not necessarily limiting. The term radiation curing includes any method of curing printed using electromagnetic radiation such as UV or electro-beam curing.

To obtain a toner with a very high scratch resistance normally a toner could be prepared comprising both a high viscosity resin and a wax. But using a high viscosity binding resins means that during production of the toner, e.g. by the melt production process, i.e. melt extrusion and milling, and also during the fusing of the toner, very high amounts of energy are necessary which is not desired from economical and ecological point of view. By including a wax in the toner composition the scratch resistance can also be improved. Several teachings can be found describing the use of waxes in the toner such as US2004/0142265, U.S. Pat. No. 5,928,825, EP1111474 and "Study on the effects of wax in the polyester color toner" (IS&T NIP 16 page 618).

From those references, it can be learned that preferentially the wax is present in a concentration typical between 3 and 10% for conventional melt extruded toner and somewhat higher for chemically produced toner. Without excluding any theory, the generally accepted working principle of a wax is that during the fusing step the wax migrates towards the toner surface resulting in a surface with a lower friction coefficient or surface energy. To be effective as releasing agent, also the dispersion of the wax and the domain size of the wax is important. The domain size of wax is also related to the wax concentration. The domain size can be controlled by adapting the chemistry of the waxes, the chemistry of the binder resin or the production conditions during for example the extrusion step. When reactive resins are used in the toner formulation like in UV curable toners there are some limitations towards the processing conditions.

When the domain size of the wax particles is large (e.g. from 200-2000 nm) and the content of the wax particles is high (>3%), the chance that these wax parts are present in the toner surface is very high since the toner fragments preferentially on the inter phase resin-wax during the milling process the resulting toner may not yield images with good quality because the presence of wax occurring in the toner surface results in impaired fluidity, filming on the photoconductor and filming on the carrier causing charge degradation of the developer. When higher amounts of waxes are present to improve the scratch resistance this has been shown to result in toners with decreased anti blocking properties and a decreased yield during the production. When the wax is too fine dispersed (e.g. below 200 nm domain size) and/or present in too low concentrations insufficient releasing ability of the wax will occur with respect to the fusing process and also the scratch resistance induced by its presence.

Another important aspect of the toner and corresponding developer (e.g. for a two component developer) is any one of, or any combination of the charge stability, developability, storage stability and the lifetime of the developer especially when toners with a particles size Dv50<10 μm and high demanding, high volume, full colour printing applications are considered. With the presence of waxes in concentration between 3 and 15%, even when dispersed at the proper domain size, those properties are very difficult to achieve because there will always be a tendency of filming on the photoconductor and the carrier causing charge degradation and thus loss in image quality and limited developer lifetime. So, reducing the wax content results in a better electrophotographic behavior, but decreases the fusing window and the scratch resistance. Despite this wax concentrations are typically used between 3 and 10% for conventional melt extruded toner and somewhat higher for chemically produced toner because in that production process, the opportunity exists to concentrate the wax in the center of the toner particle, thereby reducing the presence of the wax compound in the surface of the toner particle.

In order to guarantee a high image quality at start of the developer and over the lifetime of the developer and to maintain a stable charge of the developer, rounding of the toner particles is desirable. Several methods exist for rounding the toner such as mechanical milling, thermal treatment or producing the toner by a chemical processes (making particles in a liquid phase). Preferably a thermal treatment is used because this method results in the highest flexibility towards toner composition and roundness and gives access to the highest throughputs too. When the rounding is accomplished by a thermal treatment, it has been found out recently that the upper wax concentration should be limited to 3% by weight in order to result in a toner formulations that is suited for long living dual component developer systems for high image quality production printing. When the wax concentration is above 3% by weight the toner starts to form lumps during the thermal rounding treatment resulting in a changed/increased inhomogeneity of the size distribution, combined with an increase in size too. By choosing the right rounding conditions the formation of the lumps can be minimized but not completely avoided and the yield will be low compared to the rounding of a non wax containing toner, and it will never be possible to avoid the increase of the wax content onto the surface area of the toner.

Another method to improve the scratch resistance is to apply a certain amount of oil on top of the toner image. This can be done during the hot roller fusing step where the oil acts as a releasing agent to prevent hot offset or afterwards in a separate step. The disadvantage of this method is that quite large amounts of oil are necessary to obtain the desired scratch resistance resulting in greasy look and feel images. Also the scratch resistance degrades over time due to evaporation of the oil and further penetration in the substrate. By selecting the right type of silicon oil in terms of viscosity and chemistry those phenomena can be delayed but not prevented. The present invention does not exclude the use of oil, but makes it certainly less necessary in order to obtain the right degree of scratch resistance.

For the production of high quality images a non-contact fusing is preferred but the present invention is not limited only thereto. In the case of non contact (e.g. IR) there is no contact between the toner image and the fusing elements.

The term scratch resistance is very generally used and thus has not always the same meaning. In the present application the scratch resistance is referred to as the level of damaging of an image with a stylus with a certain hardness under a certain load by a linear movement (see also below when the method is described). Another parameter that is very often used to describe the durability of an image is the abrasion resistance. Here the image is rubbed either in a rotational or linear mode with materials with different roughness and hardness (different sandpapers), like the well known "Tabor Test".

After elaborated investigations it has now been found that a toner comprising a radiation curable polymer and a wax in a concentration lower than 3% by weight improves the scratch resistance to unexpected high levels after curing. The toner can be prepared by a conventional melt extrusion process. The level of scratch resistance that can be obtained was higher than one could expect from combining the effect of radiation curing and the use of a wax in small concentrations. If one looks at non wax containing normal UV curable toner and compares cured versus non-cured, then one observes a slight scratch resistance increase of maximum 2. When a small amount of wax (e.g. 1-2% by weight) is introduced and the same comparison is made (cured versus non-cured), one then observes an increase of a factor 4-10, which shows the superadditive effect of these two factors.

TABLE

| Scratch resistance (see also further) | | |
|---|---|---|
| Wax | Not cured | Cured |
| 0 | 7 | 14 |
| 1 | 18 | 180 |
| 2 | 300 | 990 |
| 5 | 1020 | 1270 |

This improvement in scratch resistance is even more pronounced when the toner images are fused in a non-contact fusing process. However as indicated below (e.g. with reference to FIG. 1), increase in scratch resistance is not the only parameter that determines the design of toner particles. It suffices to say that from the above table the improvement is most pronounced when the wax content is around 2% by weight.

The physical interpretation is not completely clear but a possible explanation, without excluding any other theory or being limited to any, could be that during the radiation curing, the viscosity and the temperature increase dramatically at the same time, together with a internal structural change over a very short time period and as a consequence the wax is squeezed out to the toner surface. The viscosity increase is caused by the crosslinking of the radiation and a part of the curing energy causes a temperature increase also.

The advantage provided by use of only 0.3 to 3% by weight of waxes for the improvement of the scratch resistance is that small amounts of waxes do not interfere with the production during the extrusion, milling, classifying and rounding step. Above a concentration of 3% by weight a clear decrease in production yield is observed and the storage stability of the toner becomes worse. Also the electrophotographic properties of the toner particles like one or more of charge stability, developability and transfer efficiency are not influenced when the wax concentration is lower than 3% by weight because smearing on carrier and photoconductor doesn't occur. As a summary, it has been found out that a low amount of wax, combined with UV curing, yields in an unexpected manner that a scratch resistance that is even higher than the values achieved if high amounts of wax are used, can be achieved, but without the negative effects of these higher amounts of waxes.

When the concentration of the wax is lower than 0.3% by weight the effect on the scratch resistance is too low. Preferably, in some embodiments, the concentration of the wax is between 0.6 and 2% by weight.

A broad range of wax that can be used for this aspect of the present invention, preferably has a main peak molecular weight (Mp) of 500 to 20,000 measured by GPC and ratio (Mw/Mn) of weight average molecular weight (Mw) to number average molecular weight (Mn) of 1.0 to 20. Particularly suitable wax are for example but not limited to long chain hydrocarbons (such as paraffin wax and Sasol wax, etc.) and carbonyl group-containing waxes, etc.

The toner of the present invention, may contain more than one wax type, e.g. it may contain two different types of waxes. As indicated above, wax contained in the toner of the present invention can be selected from ester wax, hydrocarbon wax, polyolefin (such as polyethylene wax and polypropylene wax, etc.). Wax contained in the toner of the present invention can be a natural, a semisynthetic or a synthetic hydrocarbon. In the case where two types of wax are contained in the toner of the present invention, at least one of them is one of the aforementioned types of wax.

Additionally, a wax as well as the toner binder and the coloring agent or pigment can be included. For the wax in the present invention, publicly known waxes can be used. As for the wax, examples are polyolefin (such as polyethylene wax and polypropylene wax, etc.), long chain hydrocarbons (such as paraffin wax and Sasol wax, etc.) and carbonyl group-containing waxes, etc.

Among these, the carbonyl group-containing waxes can be used. As the carbonyl group-containing wax, polyalkane-based carboxylic acid esters (such as carnauba wax, montan wax, trimethylolpropane tribehenate, pentaerythritoltetrabehenate, pentaerythritoldiacetatedibehenate, glycerin-tribehenate, and 1,18-octadecanedioldistearate, etc.), polyalkanolesters (such as tristearyl trimellitate and distearyl maleate, etc.), polyalkane-based amides (such as dibehenylamide of ethylenediamine, etc.), polyalkylamides (such as tristearyl amide of trimellitic acid, etc.) and dialkylketones (such as distearyl ketone, etc.), etc. are suitable. From the carbonyl group-containing waxes, polyalkane-based carboxylic acid esters can be used.

The melting point of the wax used in the present invention is preferably below 140° C. and more preferably below 120° C. It can be in the range 40 to 140° C., e.g. between 50 and 120° C., or, for example, between 60 and 90° C. When the wax has a melting point lower than 40° C., the heat resistance for preservation of obtained toners is lowered. When the wax has a melting point much higher than 140° C., e.g. 160° C. The wax doesn't perform as well as scratch resistance preventor. Also, the melt viscosity of the wax that is measured at temperature higher than the melting point by 20° C. is preferably comprised between 5 and 1,000 cps (between 0.005 and 1 Pa·s), more preferably between 10 and 100 cps (between 0.01 and 0.1 Pa·s). When the wax has the melt viscosity higher than 1,000 cps (1 Pa·s), the scratch resistance of the toners obtained are less improved.

Although the nature and the physical properties of the waxes can be of minor importance, the proper choice of the type of wax will also affect the level of the scratch resistance and the dispersion state in the resin. Because preferably polyester based UV curable resins are used for this invention a certain compatibility of the wax with the resin is desired for a good wax dispersion. This increase in compatibility can be obtained be using waxes which contain a hydrophilic group like OH, COOH, $NH_2$, or an ester function, $OC_2H_5$. To be efficient as possible the melting point of the wax must be preferably lower than the fusing temperature and curing temperature of the toner. Preferably the melting point is lower than 140° C. and even more preferably lower than 120° C.

Commercial waxes can be obtained for example from Clariant under the tradename Licowax and from Baker Petrolite under the trade names Polywax, Unilin, Unicid and Unithox. Among them the Licowax E and Licowax F grades from Clariant and Unilin and Unicid grades Baker Petrolite are preferred. Useful radiation curable polymeric compounds, in toner particles for use in the present invention are UV curable solid epoxy resins with Tg≧40° C. as disclosed in EP667381B1. Other useful UV curable resins for incorporation in toner particles, according to this invention are toners based on (meth) acryloyl containing polyester. The term polyester includes all polymers with a backbone structure based on a polycondensation of an alcohol, preferably one or more polyols having 2 to 5 hydroxyl groups) and a carboxylic acid-containing compound. Examples of such UV curable resins are unsaturated polyesters based on terephthalic and/or isophthalic acid as the carboxylic acid-containing component, and on neopentylglycol and/or trimethylolpropane as the polyol component and whereon afterwards an epoxy-acrylate such as glycidyl (meth)acrylate may be attached. These polymers are available for instance from Cytec Chemicals under the tradename Uvecoat. Another UV curable resin is a polyester-urethane acrylate polymer which may be obtained by the reaction of an hydroxyl-containing polyester, a polyisocyanate and a hydroxy-acrylate. Another binder system useful in the present invention, e.g. a toner composed of a mixture of an unsaturated polyester resin in which maleic acid or fumaric acid is incorporated and a polyurethane containing a vinylether available from DSM Resins under the tradename Uracross. The above UV curable resins may be used alone or as a blend. According to a specific embodiment, the UV curable polymer (binder) is preferably a polyester based polymer.

The reactivity of the binder resin is expressed as the amount milli-equivalent of double bounds per gram (meq/gr) of the radiation curable resin or polymer present in the dry toner particles. This number can be calculated from the resin composition or analytically determined by the use of e.g. NMR or IR techniques standard in the polymer art.

In a preferred embodiment the glass transition temperature of said polymers is above 45° C. and the Tg of the toner is higher than 40° C.

For the UV curing to proceed it is necessary that one or more photoinitiators are present. Very useful photoinitiators in the context of this invention include, but are not limited to, compounds such as shown in the formulae I, II and III below, or mixtures of these compounds. Commercially available photoinitiators are available from Ciba Geigy under the tradename Irgacure.

Compound I

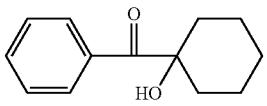

-continued

Compound II

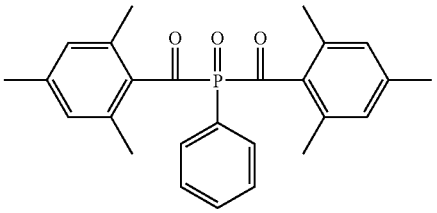

Compound III

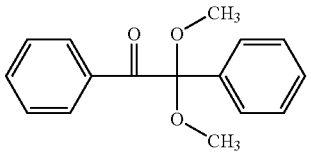

Compound I is available as Irgacure 184, compound II as Irgacure 819, and compound III as Irgacure 651.

The photoinitiator is preferably incorporated in the toner particles together with the UV curable system in a concentration range of preferably 0.5-6% by weight of the total toner formulation. If the concentration of the photoinitiator exceeds about 6% by weight, the Tg of the system can become too low.

Toner particles according to the present invention can be prepared by any method known in the art. Those toner particles can be prepared by melt kneading the toner ingredients (e.g. toner resin(s), charge control agent(s), pigment(s), etc) and said radiation curable compounds. After the melt kneading the mixture is cooled and the solidified mass is pulverized and milled and the resulting particles classified. After the classifying step is rounding step is performed followed by the mounting of the surface additives. According to a specific embodiment the toner particles are preferably melt-extruded.

Toner particles useful in this invention can have an average volume diameter (size) between about 3 and 20 μm. When the toner particles are intended for use in colour imaging, it is preferred that the volume average diameter is between 4 and 12 μm, most preferred between 5 and 10 μm. The particle size distribution of said toner particles can be of any type. It is however preferred to have an essentially (some negative or positive skewness can be tolerated, although a positive skewness, giving less smaller particles than an unskewed distribution, is preferred) Gaussian or normal particle size distribution, either by number or volume, with a coefficient of variability (standard deviation divided by the average) (v) smaller than 0.5, more preferably of 0.3.

According to a specific embodiment, the toner particles of the first aspect of the invention are preferably non-encapsulated, i.e. the toner particles are not produced by a coagulation method in two steps whereby the wax domains are covered by an amount of non wax containing resin in the liquid phase.

Toner particles, useful in this invention, can comprise any normal toner ingredient e.g. colouring agents e.g. pigments or dyes both coloured and black, inorganic fillers, anti-slip agents, flowing agents, waxes, etc.

Toners for the production of colour images may contain organic dyes/pigments of for example the group of phtalocyanine dyes, quinacridone dyes, triaryl methane dyes, sulphur dyes, acridine dyes, azo dyes and fluorescein dyes. Also $TiO_2$ or $BaSO_4$ can be used as a pigment to produce white toners. In order to obtain toner particles with sufficient optical density in the spectral absorption region of the colorant, the colorant is preferably present therein in an amount of at least 1% by weight with respect to the total toner composition. To improve the distribution of the colorant in the toner resin, it may be beneficial to add a so called master batch of the colorant during the toner preparation in stead of adding the pure colorant. The master batch of the colorant is prepared by dispersing a relatively high concentration of the colorant, present as pure pigment or as press cake, preferably ranging from 20 to 50% by weight in a resin, that does not need to be the radiation curable polymer, e.g. a polyester. The same master batch techniques can also be used for dispersing charge control agents and photo initiators.

The toners of the present invention can also contain charge controlling agents to adjust the charging properties of the toner. The charge controlling agents can be present at the surface of the toner or in the bulk. Positive and negative charge control agents can be used to adjust the triboelectric chargeability in either negative or positive direction. Very useful charge control agents for providing a net positive charge to the toner particles are, for example, nigrosine compounds (more particularly Bontron N04, trade name of Orient Chemical Industries—Japan) and quaternary ammonium salts. Charge control agents for yielding negative chargeable toners are, for example, metal complexes of salicylate (e.g. Bontron E84 or E88 from Orient Chemical Industries and Spilon Black TRH from Hodogaya Chemicals), and organic salts of an inorganic polyanion (Copycharge N4P, a trade name from Clariant). Preferably are the metal complexes of salicylate like Bontron E84 and Bontron E88 especially for colour applications because they are colourless. Reference is made to the EP patent application with application number 06025300 entitled "Rounded Radiation Curable Toner", which is incorporated herein by reference in its entirety.

The toner particles can be used as mono-component developers, both as a magnetic and as a non-magnetic mono-component developer. The toner particles can be used in a multi-component developer (e.g. two component developers) wherein both magnetic carrier particles and toner particles are present or in a trickle type development where both toner and carrier are added to the developer system with simultaneous removal of a part of the developer mixture. The toner particles can be negatively charged as well as positively charged.

Carrier particles can be either magnetic or non-magnetic. Preferably, the carrier particles are magnetic particles. Suitable magnetic carrier particles have a core of, for example, iron, steel, nickel, magnetite, $\gamma$-$Fe_2O_3$, or certain ferrites such as for example CuZn and environmental friendly ferrites with Mn, MnMg, MnMgSr, LiMgCa and MnMgSn. These particles can be of various shapes, for example, irregular or regular shape. Generally these carrier particles have a median particle size between 30 and 65 μm. Exemplary non-magnetic carrier particles include glass, non-magnetic metal, polymer and ceramic material. Non-magnetic and magnetic carrier particles can have similar particle size. Preferably the carrier core particles are coated or surface treated with diverse organic or inorganic materials or resins in a concentration of 0.4 to 2.5% by weight to obtain, for example, desirable electrical, triboelectrical and/or mechanical properties.

In a two-component developer according to embodiments of the present invention the amount of UV curable toner particles can be, for example, between about 3 and about 12 weight % (relative to the amount of developer).

Tribo-electric charging of the toner particles proceeds in so-called two component developer mixtures by means of the carrier particles. Charging of individual toner particles through triboelectricity is a statistical process, which will result in a broad distribution of charge over the number of toner particles in the developer. The charge can be measured with a q/d meter from Dr R. Epping PES Laboratorium D 8056 Neufahrn. The apparatus measures the distribution of the toner charge (in fC) with respect to a measured toner diameter (diameter in 10 μm). The measurement results are expressed as a percentage particle frequency of the same q/d ratio (y-axis) on q/d ratio expressed as fC/10 μm (in x-axis). If a relative large amount of toner particles have a charge too low for providing a sufficiently strong coulomb attraction, the development of such kind of developer results in undesirable image-background fog. To avoid such fog in the printed image, the distribution of charge/diameter (q/d) of the toner particles needs to range from an absolute value of 3 to 15 fC/10 μm, more preferably 4-12 and even more preferably 5-11 fC/10 μm.

The substrate onto which the UV curable toner is applied, e.g. printed, can be any suitable substrate, e.g. paper, plastic and metal foils or combinations thereof, having different thicknesses or ceramic surfaces. The toners mentioned in this patent application could also be used in a powder coating process, followed by UV or EB curing. The paper substrate can have a smooth surface, may have a glossy finish, can be coloured or uncoloured and weighs for example 10 to 300 $mg/cm^2$.

Multilevel materials can be made out of two or more foil layers, e.g. paper, plastics and/or metal foils.

Examples of metal foils as substrates are foils from iron, steel, and copper and preferentially from aluminium and its alloys.

Suitable plastics are e.g. polyvinyl chloride (PVC), polyvinylidene chloride (PVDC), polyester, polycarbonates, polyvinyl acetate, polyolefins and particularly polyethylenes (PE), like polyethylene of high density (HDPE), polyethylene of middle density (MDPE), linear polyethylene-middle density (LMDPE), polyethylene low-density (LDPE) and linear polyethylene low-close (LLDPE).

The thickness of the substrates can range from e.g. of 5 μm to 1000 μm, preferably 15 to 200 μm. For papers, coated on one side with plastic or metal foil, the thickness can vary from 5 to 500 μm, preferably 30 to 300 μm. The thickness of plastic foils can range from 8 to 1000 μm thick. Metal foils can exhibit a thickness from 5 to 300 μm.

The substrate can be fed by means of a web, preferably for thin substrates in order to avoid jams, or by means of sheets.

The present invention also includes a method for forming a toner image on a substrate comprising the steps of:

i) image-wise depositing on said substrate coloured rounded toner particles comprising a radiation curable resin a photoinitiator, a pigment or colouring agent, and a wax; wherein the wax is present in a concentration ranging from 0.3 to 3% by weight,
ii) fusing said toner particles on said substrate, and
iii) radiation curing said fused toner particles.

In a preferred embodiment the image wise deposition on said substrate is done by image wise developing a latent image on a photoconductor and transferring said developed toner image by an intermediate means or directly to the substrate. In some cases the pigment can be omitted, resulting in a transparent toner layer deposition for creating special effects like gloss or the like.

The radiation curing can proceed in line or off line.

Inline curing means that the curing proceeds in the fusing station of the apparatus itself (e.g. with the use of UV-light transparent fuser rollers) or in a station immediately adjacent to said fusing station.

The radiation curing can also proceed off-line in a separate apparatus. In this case the fused toner images can be fed immediately to this separate curing apparatus without first stacking or rewinding the substrate. It is also possible to rewind or stack first the substrate before feeding it again to the curing station. It can be beneficial that the fused toner is reheated again so that the toner layer becomes again in a molten state before the radiation (UV) curing proceeds.

Preferably said radiation curing proceeds at a temperature that preferably is at most 150° C. Therefore it is preferred to use toner particles, comprising a radiation curable compound having a Tg≧45° C., that have a melt viscosity at 120° C. between 50 and 3000 Pa·s, preferably between 100 and 2000 Pa·s.

The present invention further includes an apparatus for forming a toner image on a substrate comprising the steps of:

i) means for image-wise depositing toner particles on said substrate, the toner particles comprising a radiation curable resin, a photoinitiator, a pigment or colouring agent, and a wax; wherein the wax is present in a concentration ranging from 0.3 to 3% by weight,
ii) means for fusing said toner particles on said substrate,
iii) means for off-line or in-line radiation curing said fused toner particles.

The means for radiation curing is preferably a means for UV radiation curing.

In a preferred apparatus according to this invention the substrate is fed from web but sheet feed may also be used.

Said means for fusing said toner particles to the substrate can be any means known in the art, the means for fusing toner particles according to this invention can be contact (e.g. hot-pressure rollers) or non-contact means. Non-contact fusing means according to this invention can include a variety of embodiments, such as: (1) an oven heating process in which heat is applied to the toner image by hot air over a wide portion of the support sheet, (2) a radiant heating process in which heat is supplied by infrared and/or visible light absorbed in the toner, the light source being e.g. an infrared lamp or flash lamp. According to a particular embodiment of "non-contact" fusing the heat reaches the non-fixed toner image through its substrate by contacting the support at its side remote from the toner image with a hot body, e.g., a hot metallic roller. In the present invention, non-contact fusing by radiant heat, e.g., infrared radiation (IR-radiation), is preferred.

In a contact fusing process, the non-fixed toner images on the substrate are contacted directly with a heated body, i.e. a so-called fusing member, such as fusing roller or a fusing belt. Usually a substrate carrying non-fixed toner images is conveyed through a nip formed by establishing a pressure contact between said fusing member and a backing member, such as a roller. To obtain high quality images, it is recommended to use hot roller systems with a low amount of release agents.

In an apparatus according to the present invention it is preferred to use toner particles comprising a UV-curable resin and thus the means for radiation curing the toner particles comprise are means for UV-curing (UV-light emitters as e.g. UV lamps). In an apparatus according to the present invention, it is preferred that the radiation curing proceeds inline. Therefore it is preferred that said means for fusing said toner images emit infrared radiation (i.e. are infra-red radiators) and said means for UV curing (e.g. one or more UV emitting lamps) are installed immediately after said fusing means so that the UV curing proceed on the still molten toner image. Different techniques exist for activating the UV lamps: UV lamps powered by microwave technology or arc lamps. Different types of UV lamps can be used and the choice of the type of UV lamp that will be used, i.e. V, D, F bulb, will depend on the toner formulation and on the type of photo initiator that is used. A proper match between the emission spectrum of the UV lamp and the absorption spectra of the used photo initiator is recommended to obtain an efficient curing. A combination of infra-red radiators (the means for fusing the toner particles) and UV emitting lamps (the means for radiation curing) in a single station (a fixing/curing station), so that the fusing and the radiation curing proceed simultaneously, is also a desirable design feature of an apparatus according to this invention. The apparatus according to the present invention can comprise if so desired, more than one fixing/curing station. The UV emitting means are preferably UV radiators with a UV power between 25 W/cm and 250 W/cm. Depending on the curing speed and the chosen UV power will thus result in a UV dose of 0 to 5 J/cm2.

The means for image-wise depositing toner particles can, in an apparatus according to this invention, also be by direct electrostatic printing means (DEP), wherein charged toner particles are attracted to the substrate by an electrical field and the toner flow modulated by a printhead structure comprising printing apertures and control electrodes.

Said means for image-wise depositing toner particles can also be toner depositing means wherein first a latent image is formed. In such an apparatus, within the scope of the present invention, said means for image-wise depositing toner particles comprise:

i) means for producing a latent image on a latent image bearing member, ii) means for developing said latent image by the deposition of said toner particles, forming a developed image, and iii) means for transferring said developed image on said substrate.

Said latent image may be a magnetic latent image that is developed by magnetic toner particles (magnetography) or, preferably, an electrostatic latent image. Such an electrostatic latent image is preferably an electrophotographic latent image and the means for producing a latent image are in this invention preferably light emitting means, e.g., light emitting diodes or lasers and said latent image bearing member comprises preferably a photoconductor.

For example, the present invention includes an electrostatographic single-pass multiple station printer. It is understood that electrostatographic single-pass multiple station printers will usually use dry-particulate toner, however the invention is equally applicable where the toner particles are present as a dispersion in a liquid carrier medium (e.g. silicon oil) or in a gas medium in the form of an aerosol (powder coating)

The electrostatographic single-pass multiple station printers described with reference to the present invention may especially be a colour printer comprising image printing stations for each of a sequence of 3 or more primary colours such as yellow, magenta, cyan as well as other printing stations, e.g. for black toner images or for spot colour toner images. Such printing stations being provided to provide images only on one side of the printing medium in a single side printer, or alternatively, of each of such stations one is present to print on each of the sides of the printing medium in a double side printer.

Figure 2:
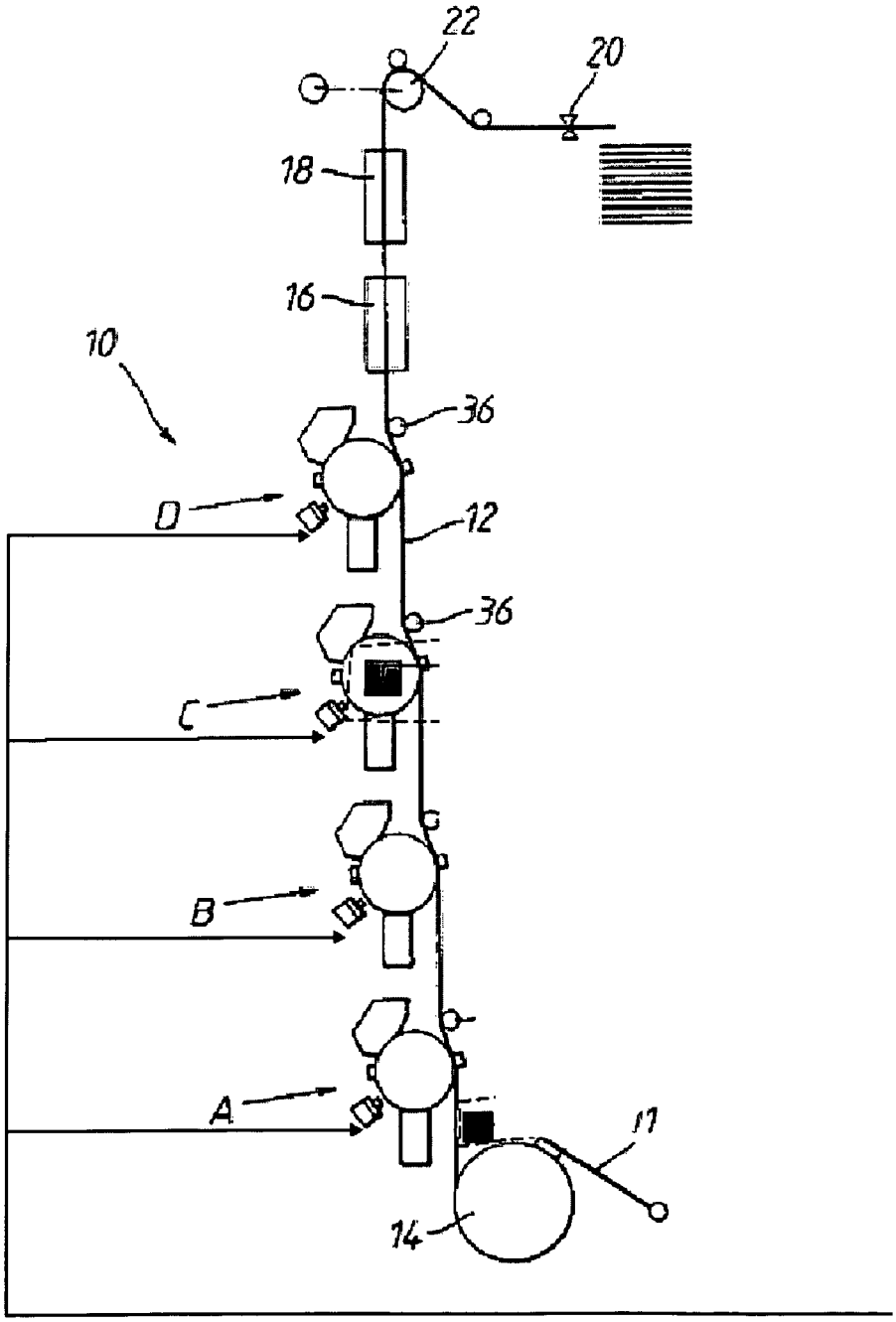
FIG. 2 is a schematic representation of a printer for use with the present invention, showing a single-side electrostatographic single-pass multiple station printer.

FIG. 2 shows a schematic representation of a side view of a single-side electrostatographic single-pass multiple station printer 10. The printer 10 illustrated comprises 4 consecutive printing stations labelled A, B, C and D, which are arranged to e.g. print yellow, magenta, cyan and black respectively. It is to be understood that the configuration illustrated is not intended to be limiting for the present invention, and that a configuration with more or less printing stations is included in the present invention as well. The printing stations A, B, C and D are arranged in a substantially vertical configuration, but it is to be understood that a substantially horizontal configuration or any other configuration might apply. The printing medium 12 is unwound from a supply roller 14, and in the example illustrated is a printing web, such as e.g. a paper web. The printing medium is pulled through the printer 10 by means of a motor driven drive roller 22. Tension is provided to the printing medium 12 by a brake 11 located at the supply roller 14. The printing medium 12 is conveyed in upward direction past the printing stations A, B, C, D in turn. The moving printing medium 12 is in face-to-face contact with the surfaces 26 of the drums 24 (see also FIG. 3) of the printing stations A, B, C and D. After having passed the last printing station D in the row, the printing medium 12 is passed trough an image fixing station 16 and a UV curing zone 18. The printer may furthermore optionally comprise a cutting device 20.

Test Methods

Circularity:

The circularity is a parameter which indicates the roundness of a particle. When the circularity is 1.00 the particle is a perfect sphere. The circularity of the toner is a value obtained by optically detecting toner particles, and is the circumference of a circle with the same projected area as that of the actual toner particle divided by the circumference of the actual toner particle. Specifically, the average circularity of the toner is measured using a flow particle image analyser of the type FPIA-2000 or FPIA-3000 manufactured by Sysmex corp. In this device, a sample is taken from a diluted suspension of particles. This suspension is passed through a measurement cell, where the sheath flow ensures that all particles of the sample lie in the same focusing plane. The images of the particles are captured using stroboscopic illumination and a CCD camera. The photographed particle image is subjected to a two dimensional image processing, and an equivalent circle diameter and circularity are calculated from the projected area and peripheral length.

Particle Size of Toner:

The $dv_{50}$ is the particle size where 50% in volume of the particles have a size which is smaller than the $dv_{50}$. This size is measured with a Coulter Counter (registered trade mark) Multisizer particle size analyzer operating according to the principles of electrolyte displacement in narrow aperture and marketed by Coulter Electronics Corp. Northwell Drive, Luton Bedfordshire, LC33 UK In said apparatus particles suspended in an electrolyte (e.g. aqueous sodium chloride) are forced through a small aperture, across which an electric current path has been established. The particles passing one-by-one each displace electrolyte in the aperture producing a pulse equal the displacement volume of electrolyte. Thus particle volume response is the base for said measurement.

Charge Measurement of Toner Particle:

The charge is measured with a q/d meter from Dr. R. Epping PES Laboratorium D 8056 Neufahrn. The apparatus measures the distribution of the toner particles charge (in fC) with respect to a measured toner particle diameter (diameter in 10 μm). The measurement results are expressed as a percentage particle frequency of the same q/d ratio (y-axis) on q/d ratio expressed as fC/10 μm (in x-axis). From those data the mean q/d value can be calculated Charge Stability Measurement of Developer:

The charge of the developer is measured at start and after activation for 48 h in a developer unit of a Xeikon 6000 print engine by a Q/d meter from Epping.

Ranking

1: very strong decrease in charge after 48 h of activation

4: strong decrease in charge after 48 h of activation

6: acceptable decrease in charge after 48 h of activation

8: moderate decrease in charge after 48 h of activation

10: no decrease in charge after 48 h of activation

Melt Viscosity of Toner Particles:

The meltviscosity is measured in a CSL2 500 Carr-Med Rheometer from TA Instruments at 120° C. The viscosity measurement is carried out at a sample temperature of 120° C. The sample having a weight of 0.75 g is applied in the measuring gap (about 1.5 mm) between two parallel plates of 20 mm diameter one of which is oscillating about its vertical axis at 6 rad/sec and amplitude of $10^{-3}$ radians. The sample is temperature equilibrated for 10 min at 120° C.

Scratch Resistance:

The scratch resistance is measured by a AATCC Crocktester model CM5 manufactured by Altas Electric Devices Chicago. A stylus rests on the image sample with a pressure equivalent to a mass load of 900 g and the arm is repeatedly moved back and forth across the image with a strokelength of 56 mm till the image is completely damaged.

Measurements are done on samples with an applied mass of 0.5 mg/cm2 on a 100 gsm paper (Digicolor Laser 100 gsm from UPM). Samples are fused for 7 min at 125° C.

Ranking (One Repetition Corresponds to a Back and Forth Movement of the Arm):

0: 0-10 repetitions
1: 10-40 repetitions
2: 40-70 repetitions
3: 70-100 repetitions
4: 100-150 repetitions
5: 150-225 repetitions
6: 225-300 repetitions
7: 300-500 repetitions
8: 500-750 repetitions
9: 750-1000 repetitions
10: >1000 repetitions

EXAMPLES

Toners were prepared by melt blending for 30 minutes in a laboratory kneader at 110° C. the ingredients, together with 3% by weight of a phtalocyanine blue pigment. After cooling, the solidified mass was pulverized and milled using a Alpine Fliessbettgegenstrahimuhle 100AFG (trade name) and further classified using a multiplex zig-zag classifier type 100MZR (trade name) to obtain a toner with a dv50 between 7 and 9 μm.

In order to improve the flowability of the toner, the particles were mixed with 0.5% by weight of hydrophobic colloidal silica from Degussa.

| Toner | Resin | Amount of Photoinitiator (weight-%) | Amount of Wax (weight-%) |
|---|---|---|---|
| T1 | Conventional polyester resin | — | — |
| T2 | Polyester based UV curable resin | 1% BAPO | — |
| T3 | Polyester based UV curable resin | 1% BAPO | 1% |
| T4 | Conventional polyester resin | — | 2% |
| T5 | Polyester based UV curable resin | 1% BAPO | 2% |
| T6 | Conventional polyester resin | — | 5% |
| T7 | Polyester based UV curable resin | 1% BAPO | 5% |
| T8 | Polyester based UV curable resin | 1% BAPO | 4% |

Wherein when used the photoinitiator is a bisacylphosphine oxide and the wax is a COOH modified PE wax having melting temperature of 105° C.

From toners T1 to T8 developers D1 to D8 were prepared by mixing 5 g of said toner particles together with 100 g of a coated silicone MnMgSr ferrite carrier with a dv50 of 45 μm. The results of the toners and developer are summarised in table 2. With toner T6, T7 and T8 a very low production yield was obtained and during the activation of the developers D6 for 48 h toner lumps and developer lumps were formed.

From some toners a rounded, potato shaped toner was prepared and checked for charge stability. With toner T7 and T8 unacceptable amounts of lumps were formed during the thermal rounding step. Results are also mentioned in table 2.

TABLE 2

| A toner | B developer | C Charge (q/d) | D Roundness | E Charge stability | F Scratch | G Scratch*charge stability (1) |
|---|---|---|---|---|---|---|
| T1 | D1 | 8 | 0.946 | 10 | 0 | |
| T2 | D2 | 6 | 0.943 | 9 | 1 | 1 |
| T2 | D2R | 7 | 0.970 | 8 | 1 | 1 |
| T3 | D3 | 7 | 0.948 | 9 | 5 | 45 |
| T3 | D3R | 8 | 0.964 | 8 | 5 | 40 |
| T4 | D4 | 7 | 0.942 | 7 | | |
| T5 | D5 | 8 | 0.943 | 7 | 9 | 63 |
| T5 | D5R | 8 | 0.978 | 6 | 9 | 54 |
| T6 | D6 | 7 | 0.943 | 1 | 9 | |
| T7 | D7 | 8 | 0.942 | 1 | 10 | 10 |
| T7 | D7R | 7 | 0.971 | 0 | 10 | 0 |
| T8 | D8 | 7.5 | 0.943 | 2 | 10 | 20 |
| T8 | D8R | 7.5 | 0.973 | 1 | 10 | 10 |

(1) for cured samples

Table 2 shows that the charge stability decreases by rounding the toners when a wax is present in the toner.

Column G of table 2 and graph 1 show that when the wax concentration is in the right range the charge stability, as well as the scratch resistance, are at an acceptable level. Above 3% by weight the scratch resistance is very good but due to the bad charge stability those toners can not be used. This is even more pronounced for rounded toners. On the other hand when the wax concentration is too low the charge stability is excellent but the level of scratch resistance is too limited.

According to a specific embodiment the shape factor of the toner (roundness) is preferably equal to or higher than 0.94, for example equal to or higher then 0.96 or equal to or higher than 0.97.

To evaluate the scratch resistance images were developed with an applied mass of 0.6 mg/cm$^2$ on uncoated 100 gsm paper and fused at 125° C. for 7 min in an oven. Results are shown in table 3

TABLE 3

| Toner | % wax | Curing (w/cm) | Speed (cm/s) | Scratch resistance | Scratch resistance before curing | Ratio between scratch resistance after and before curing |
|---|---|---|---|---|---|---|
| T1 | 0 | — | | 7 | 7 | 1 |
| T3 | 1 | — | | 18 | 18 | 1 |
| T3 | 1 | 140 | 20 | 117 | 18 | 6.5 |
| T3 | 1 | 140 | 12 | 180 | 18 | 10 |
| T2 | 0 | 140 | 12 | 14 | 7 | 2 |
| T4 | 2 | — | | 300 | 300 | 1 |
| T5 | 2 | 140 | 12 | 990 | 300 | 3.3 |
| T6 | 5 | — | — | 1020 | 1020 | 1 |
| T7 | 5 | 140 | 12 | 1270 | 1020 | 1.2 |

Table 3 clearly shows that similar scratch resistance can be obtained using a much lower concentration of wax with a UV curable toner (T5) as compared to a non cured toner (T6).

FIG. 1 shows the effect on wax content of the combination of a processing parameter such as charge stability and scratch resistance. From FIG. 1 it is clear that other important toner properties are affected in the lower wax concentration area. The combination of a low amount of wax in a UV curable toner gives overall a much better performing toner system, e.g. better suited for industrial digital printing applications. FIG. 1 indicates that if two criteria are taken, e.g. a combination of scratch resistance and a toner processing parameter such as charge stability, that an optimum exists for both rounded and non-rounded toner particles when the wax content lies below 3% weight, e.g. an optimum is present in the range 0.3 to 3% by weight. Hence, according to embodiments of the present invention toner particles are provided that when applied to substrate and fused markings are formed, e.g. indicia are printed, the fused markings have a first value of scratch resistance and the toner particles have a second value of a processing parameter, e.g. charge stability, developability, storage stability or the lifetime of a developer including the toner particles, whereby the combination (e.g. the multiplication or addition thereof) of the first value of scratch resistance and the second value for the processing parameter is optimised by selecting the wax concentration in a low wax region, e.g. between 0.3 and 3% by weight.

The invention claimed is:

1. A toner comprising a UV curable polymer, a photoinitiator and a wax, wherein the amount of wax is at least 0.3 and below 3% by weight of said toner, wherein the toner is configured so that when toner particles of the toner are image-wise deposited and fused on a substrate, the ratio of scratch resistance after curing to scratch resistance before curing is at least 2, and wherein said toner is melt-extruded.

2. The toner according to claim 1, wherein said wax has a melting point below 140° C.

3. The toner according to claim 1, wherein said wax has a main peak molecular weight, as measured by GPC, ranging from 500 to 20,000 and a ratio weight average molecular weight to number average molecular weight ranging from 1.0 to 20.

4. The toner according to claim 1, wherein the toner particles are non-encapsulated.

5. The toner according to claim 1, wherein said UV curable polymer is selected from the group consisting of (meth)acrylated polyester resin, (meth)acrylated epoxy/polyester resin and blends of (a) (meth)acrylated epoxy/polyester and (b) (meth)acrylated polyurethane resin.

6. The toner according to claim 1, wherein said UV curable polymer comprises a polyester-based polymer.

7. The toner according to claim 1, wherein the particles of said toner have a volume average diameter between 3 and 20 μm.

8. The toner according to claim 1, wherein the particles of said toner have a viscosity ranging from 50 to 5,000 Pa·s at 120° C.

9. The toner according to claim 1, wherein said UV curable polymer have a milli-equivalent amount of double bounds per gram of said UV curable polymer>0.7 meq/gr.

10. The toner according to claim 1, wherein the glass transition temperature of said polymer is above 45° C. and the glass transition temperature of the toner is higher than 40° C.

11. The toner according to claim 1, wherein the amount of photoinitiator is between 0.5 and 6% by weight of said toner.

12. The toner according to claim 1, where the shape factor of the toner is higher than 0.94.

13. A dry electrostatographic developer composition comprising carrier particles and a toner comprising a UV curable polymer, a photoinitiator and a wax, wherein the amount of wax is at least 0.3 and below 3% by weight of said toner, and wherein the toner is configured so that when toner particles of the toner are image-wise deposited and fused on a substrate, the ratio of scratch resistance after curing to scratch resistance before curing is at least 2, and wherein said toner is melt-extruded.

14. The dry electrostatographic developer composition according to claim 13, wherein said carrier particles have a volume average particle size comprised between 30 and 65 μm, said carrier particles comprise a core particle coated with a resin in an amount of between 0.4 and 2.5% by weight, and the absolute charge expressed as fC/10 μm is between 3 and 13 fC/10 μm.

15. A method of fusing and curing a dry UV curable toner comprising a UV curable polymer, a photoinitiator and a wax, wherein:

the amount of wax is at least 0.3 and below 3% by weight of said toner, and the ratio of scratch resistance after curing to scratch resistance before curing is at least 2, said method comprising the steps of:

image-wise depositing the toner particles on a substrate, fusing said toner particles on the substrate, curing said toner particles by means of UV-radiation.

16. The method according to claim 15 wherein the fusing step and the curing step are done in-line.

17. A substrate marked with fused toner particles comprising a UV curable polymer, a photoinitiator and a wax, wherein the amount of wax is at least 0.3 and below 3% by weight of said toner, and wherein the toner is configured so that when toner particles of the toner are image-wise deposited and fused on a substrate, the ratio of scratch resistance after curing to scratch resistance before curing is at least 2, and wherein said toner is melt-extruded.

18. The toner according to claim 1, wherein said toner particles with carrier particles coated with a resin in an amount of between 0.4 and 2.5% by weight and having a volume average particle size comprised between 30 and 65 μm have an absolute charge expressed as fC/10 μm between 3 and 13 fC/10 μm.

19. A toner comprising a UV curable polymer, a photoinitiator and a wax, wherein the amount of wax is at least 0.3 and below 3% by weight of said toner, wherein the toner is configured so that when toner particles of the toner are image-wise deposited and fused on a substrate, the ratio of scratch resistance after curing to scratch resistance before curing is at least 2, and wherein the toner particles are non-encapsulated.

20. The toner according to claim 19, wherein said wax has a melting point below 140° C.

21. The toner according to claim 19, wherein said wax has a main peak molecular weight, as measured by GPC, ranging from 500 to 20,000 and a ratio weight average molecular weight to number average molecular weight ranging from 1.0 to 20.

22. The toner according to claim 19, wherein said UV curable polymer is selected from the group consisting of (meth)acrylated polyester resin, (meth)acrylated epoxy/polyester resin and blends of (a) (meth)acrylated epoxy/polyester and (b) (meth)acrylated polyurethane resin.

23. The toner according to claim 19, wherein said UV curable polymer comprises a polyester-based polymer.

24. The toner according to claim 19, wherein said toner is melt-extruded.

25. The toner according to claim 19, wherein the particles of said toner have a volume average diameter between 3 and 20 μm.

26. The toner according to claim 19, wherein the particles of said toner have a viscosity ranging from 50 to 5,000 Pa·s at 120° C.

27. The toner according to claim 19, wherein said UV curable polymer have a milli-equivalent amount of double bounds per gram of said UV curable polymer>0.7 meq/gr.

28. The toner according to claim 19, wherein the glass transition temperature of said polymer is above 45° C. and the glass transition temperature of the toner is higher than 40° C.

29. The toner according to claim 19, wherein the amount of photoinitiator is between 0.5 and 6% by weight of said toner.

30. The toner according to claim 19, where the shape factor of the toner is higher than 0.94.

31. The toner according to claim 19, wherein the wax concentration is between 0.3 and 2.0% by weight of the toner.

* * * * *